US007314997B1

(12) United States Patent
Mui

(10) Patent No.: US 7,314,997 B1
(45) Date of Patent: Jan. 1, 2008

(54) HIGH SPEED DATA COMMUNICATION LINK USING TRIAXIAL CABLE

(75) Inventor: Vincent Mui, Livonia, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/183,474

(22) Filed: Jul. 18, 2005

(51) Int. Cl.
*H01B 7/00* (2006.01)

(52) U.S. Cl. ..... 174/28; 174/36

(58) Field of Classification Search ..... 174/28, 174/102 R, 107, 108, 102 C, 36, 102 SP
See application file for complete search history.

(56) References Cited

U.S. PATENT DOCUMENTS

| | | | | | |
|---|---|---|---|---|---|
| 3,174,118 | A | | 3/1965 | Moore | 333/12 |
| 3,626,287 | A | * | 12/1971 | Di Niro | 324/688 |
| 3,643,007 | A | * | 2/1972 | Roberts et al. | 174/106 R |
| 4,029,889 | A | * | 6/1977 | Mizuochi | 174/11 R |
| 4,183,010 | A | * | 1/1980 | Miller | 367/154 |
| 4,270,214 | A | * | 5/1981 | Davis et al. | 455/80 |
| 4,335,412 | A | * | 6/1982 | Aschwanden | 361/50 |
| 4,376,920 | A | | 3/1983 | Smith | 333/12 |
| 4,510,468 | A | * | 4/1985 | Mayer | 333/12 |
| 4,599,483 | A | * | 7/1986 | Kuhn et al. | 174/36 |
| 4,754,102 | A | * | 6/1988 | Dzurak | 174/36 |
| 4,871,883 | A | * | 10/1989 | Guiol | 174/36 |
| 4,987,394 | A | | 1/1991 | Harman et al. | 333/237 |
| 5,095,891 | A | * | 3/1992 | Reitter | 601/4 |
| 5,107,076 | A | * | 4/1992 | Bullock et al. | 174/107 |
| 5,146,048 | A | * | 9/1992 | Yutori et al. | 174/36 |
| 5,150,442 | A | * | 9/1992 | Desmons | 385/101 |
| 5,266,744 | A | * | 11/1993 | Fitzmaurice | 174/103 |
| 5,414,213 | A | * | 5/1995 | Hillburn | 174/36 |
| 5,539,323 | A | * | 7/1996 | Davis, Jr. | 324/690 |
| 5,548,082 | A | * | 8/1996 | Palmer | 174/34 |
| 5,730,623 | A | * | 3/1998 | Krantz et al. | 439/580 |
| 5,818,243 | A | * | 10/1998 | Wakamatsu | 324/649 |
| 6,395,977 | B1 | | 5/2002 | Yamamoto | 174/36 |
| 6,596,393 | B1 | * | 7/2003 | Houston et al. | 428/389 |

OTHER PUBLICATIONS

*Single-Ended to Differential Twisted Pair Driver*, Intersil™ Application Note, May 1997, AN9723.

*Optimization Analysis of Routing Schemes for High Speed Digital Differential Signaling*, by Franco De Flaviis, Department of Electrical Engineering and Computer Science, University of California, Irvine, California 92612, Project Report 2001-2001 for MICRO Project 01-028, Industrial Sponsor(s): Conexant System, Inc.

*Understanding Single-Ended, Pseudo-Differential and Fully-Differential ADC Inputs*, Dallas *Maxim*, A/D and D/A Conversion/Sampling Circuits, Application Note 1108: Jun. 14, 2002.

* cited by examiner

*Primary Examiner*—William H. Mayo, III
(74) *Attorney, Agent, or Firm*—Young Basile

(57) ABSTRACT

A high speed data communication link has a circuit for providing a differential signal having first and second opposite phase components and a triaxial cable connected to receive the positive phase component of the signal on the inner conductor and the negative phase signal component on the center conductor which is made of wire mesh. An outer conductor such as a foil tape or wire mesh has a drain wire connected to ground and provides electric field shielding. EMI cancellation is provided by this arrangement particularly where the inner and center conductors have approximately the same resistance.

5 Claims, 1 Drawing Sheet

HIGH SPEED DATA COMMUNICATION LINK USING TRIAXIAL CABLE

FIELD OF THE INVENTION

This invention relates to high speed data communication links and more particularly to the reduction of electromagnetic and electric field emissions through the use of a differential signal source connected to a triaxial cable.

BACKGROUND OF THE INVENTION

It is well known that the transmission of high speed data signals, such as video signals, over a data link can give rise to both electromagnetic and electric field emissions around the data communication link. Where such high speed data communication links are used in proximity to field sensitive devices such as microprocessors and microcontrollers, significant operating interference issues can arise.

The greatest electromagnetic interference (EMI) and electric field interference (EFI) occurs from the use of unshielded parallel wire communication links or lines. A substantial reduction in EMI can be achieved through the use of twisted-pair wires because of the electromagnetic field canceling effect of the twisting characteristic. Even where the twisting is very tight, however, the solution for the reduction of EMI is only partial.

Of course both EMI and EFI can be totally eliminated through the use of optical fiber data communication links, but it is not always convenient or economically feasible to provide electro-optical conversion components in, for example, an automotive application where all other high speed and low speed data links are of the electrical type.

SUMMARY OF THE INVENTION

The present invention proposes the use of a triaxial cable as a data link for a differential data signal of the type having first and second opposite phase signal components. In general the first data signal component is applied to the inner conductor of the triaxial cable and the second, opposite phase signal component is applied to a middle conductor which insulatively surrounds the inner conductor. In the preferred embodiment, the middle conductor is conductive wire mesh in a cylindrical configuration and the cable further comprises an outer conductor insulatively separated from the middle mesh wire conductor. The outer conductor is contacted by a drain wire which runs the length of the triaxial cable.

In the preferred form, the inner conductor and the wire mesh center conductor are selected so as to exhibit at least approximately the same resistance per unit length and overall resistance. In this fashion, the coaxial arrangement of the inner and outer conductor carrying the first and second differential data signal components, respectively, dramatically reduces EMI and the outer conductor prevents the emission of electrical fields.

No electro-optical signal conversion is needed and high speed data communication links made in accordance with the invention can be used in automotive applications in close proximity to EMI and EFI sensitive components such as microprocessors and the like.

DETAILED DESCRIPTION OF THE ILLUSTRATIVE EMBODIMENT

Figure 1:
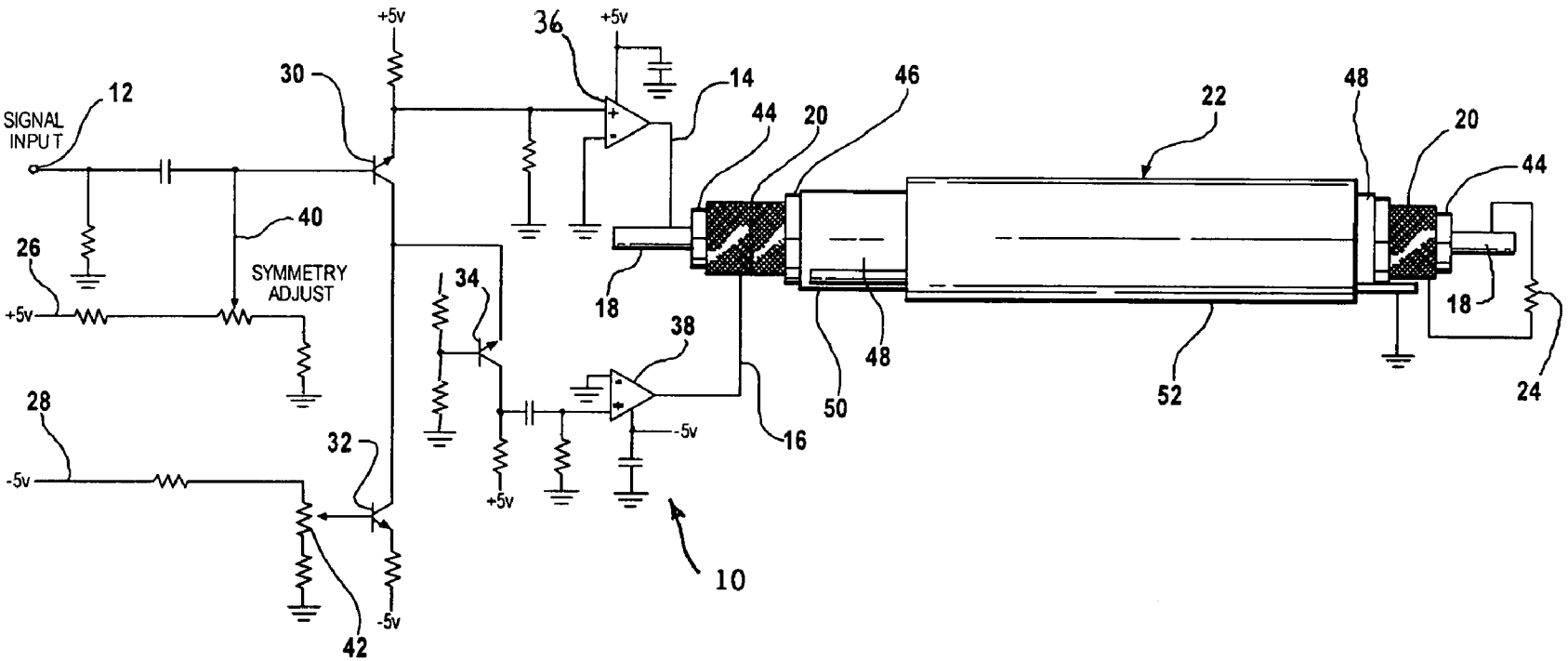
FIG. 1 shows schematically a triaxial cable used as a data communication link for a differential signal having first and second opposite differential components.

The single FIGURE drawing illustrates a circuit 10 for converting a single-ended analog or digital signal applied to input terminal 12 into a double-ended or differential signal having a first signal component on output line 14 and a second opposite phase signal component on output line 16. The circuit 10 is merely illustrative of many differential signal sources which are available. The output lines 14 and 16 are connected to the inner and center conductors 18 and 20 respectively of a triaxial cable data link 22 at the input end. The same conductors 18 and 20 are connected across a utilization device illustrated in FIG. 1 as a resistor 24.

Describing FIG. 1 in greater detail, the circuit 10 has, in addition to the input signal terminal 12, inputs 26 and 28 for positive and negative five volt potential levels. In addition, the circuit comprises transistors 30, 32 and 34 operating as a linear differential amplifier and providing opposite phase signals to the operational amplifiers 36 and 38. The outputs of the amplifiers 36 and 38 are connected to the signal lines 14 and 16 as previously described. Symmetry adjustment is provided by means of a potentiometer 40. Appropriate noise reduction and coupling capacitors are provided in the circuit 10 in combination with resistors for reasons which will be apparent to those skilled in the electronics art. The differential gain is five to seven when using the circuit configuration of FIG. 1. The gain is set in this range because a typical video signal is less than two volts in amplitude and these low gains will not cause distortion. The resistor 42 adjusts the currents of both transistors 30 and 32 and, because the gain is proportional to the emitter current of the transistors, the resistor 42 functions as a gain control.

As shown in FIG. 1, the positive phase output of the amplifier 36 is connected to the solid copper inner conductor 18 of the triaxial cable 22. An insulator 44 separates the solid inner conductor from the wire mesh center conductor 20 which is connected by way of line 16 to receive the negative phase output of the operational amplifier 38. The wire mesh center conductor 20 is configured as a cylinder to fully surround the inner conductor 18. A layer 46 of insulation separates the wire mesh cylinder conductor 20 from the foil tape outer shield or conductor 48 and the accompanying drain wire 50 which is wrapped in contact with the foil 48 within the outer insulated sheath 52. The shield 48 could comprise a wire mesh rather than a foil tape.

At the output of the data link, a utilization device 24 represented by a resistor is connected across the inner conductor 18 and the cylinder conductor 20 while the drain wire and outer electric field shielding foil tape conductor 48 are connected to ground.

The triaxial cable 22 is commercially available and can be used with the circuit 10 in lengths of up to 200 feet. Preferably, the resistance per unit length of the inner conductor 18 is chosen to be at least approximately the same as that of the center wire mesh conductor 20 for maximum EMI reduction. The method of the present invention involves, in addition to generating the differential signal having the first and second opposite phase components, applying the positive phase component to the inner conductor while simultaneously applying the negative phase component to the center conductor 20. The drain wire 50 and the foil shield 48 are connected to ground.

It will be understood that the circuit of FIG. 1 is merely illustrative and that various other circuits providing differential signals in various forms may be used. Input signals may be fully differential or floating differential or pseudo-differential in character and composition.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A high speed data communication link characterized by reduced electromagnetic interference and low electric field emission comprising:

a circuit for converting an input data signal into a differential data signal having first and second instantaneously equal and opposite polarity components;

a first output line from the circuit carrying the first differential data signal component and a second output line from the circuit carrying the second differential data signal component;

a triaxial cable comprising an inner conductor connected to the first output line to receive the first differential data signal component, a middle conductor surrounding the inner conductor and separated from the inner conductor by an insulator, the middle conductor being connected to the second output line to receive the second differential data signal component; and an outer conductor surrounding the middle conductor and separated from the middle conductor by an insulation layer, the outer conductor being grounded.

2. A data communication link as defined in claim 1, wherein the middle conductor is a cylindrical conductive wire mesh.

3. A data communication link as defined in claim 1, wherein the outer conductor is a foil tape with a drain wire.

4. A data communication link as defined in claim 1, wherein the source for providing the differential data signal includes a linear differential amplifier.

5. A data communication link as defined in claim 1, wherein the middle and inner conductors exhibit approximately the same effective resistance.

* * * * *